US005609997A

United States Patent [19]

Okamoto et al.

[11] Patent Number: 5,609,997

[45] Date of Patent: Mar. 11, 1997

[54] SILVER HALIDE PHOTOGRAPHIC MATERIAL AND A PROCESSING METHOD FOR THAT MATERIAL

[75] Inventors: Yasuhiro Okamoto; Tsutomu Arai, both of Kanagawa, Japan

[73] Assignee: Fuji Photo Film Co., Ltd., Kanagawa, Japan

[21] Appl. No.: 277,414

[22] Filed: Jul. 18, 1994

Related U.S. Application Data

[63] Continuation of Ser. No. 40,981, Mar. 31, 1993.

[30] Foreign Application Priority Data

Apr. 1, 1992 [JP] Japan ..... 4-105265

[51] Int. Cl.[6] ..... G03C 1/09; G03C 1/12

[52] U.S. Cl. ..... 430/399; 430/592; 430/603; 430/604; 430/605; 430/963

[58] Field of Search ..... 430/399, 575, 430/592, 603, 604, 605, 963

[56] References Cited

U.S. PATENT DOCUMENTS

| | | | |
|---|---|---|---|
| 4,835,093 | 5/1989 | Janusonis et al. | 430/567 |
| 4,937,180 | 6/1990 | Marchetti et al. | 430/605 |
| 4,945,035 | 7/1990 | Keevert, Jr. et al. | 430/605 |
| 5,112,733 | 5/1992 | Ihama | 430/603 |
| 5,114,838 | 5/1992 | Yamada | 430/605 |
| 5,132,203 | 7/1992 | Bell et al. | 430/605 |
| 5,190,855 | 3/1993 | Toya et al. | 430/604 |
| 5,213,953 | 5/1993 | Yamamoto | 430/605 |
| 5,320,937 | 6/1994 | Ihama | 430/603 |

FOREIGN PATENT DOCUMENTS

| | | | |
|---|---|---|---|
| 457298 | 11/1991 | European Pat. Off. | 430/604 |
| 48-35373 | 10/1973 | Japan | G03C 1/02 |
| 55-45015 | 3/1980 | Japan | G03C 1/22 |
| 62-265657 | 11/1987 | Japan | 430/603 |

*Primary Examiner*—Janet C. Baxter

*Attorney, Agent, or Firm*—Sughrue, Mion, Zinn, Macpeak & Seas

[57] ABSTRACT

There is disclosed a silver halide photographic light-sensitive material having a high sensitivity and an excellent rapid processability after exposure with a camera for a plate making. The light-sensitive material comprises a support having thereon at least one light-sensitive silver halide emulsion layer containing silver halide grains. The sliver halide grains contain a metal compound having a cyanide ligand represented by Formula I and have been subjected to sensitization with a selenium sensitizer and spectral sensitization with a sensitizing dye represented by Formula II:

$$[M(CN)_mX_{6-m}]^n \quad \text{(I)}$$

wherein M represents iron, rhenium, osmium, ruthenium, or iridium; X represents a bridged ligand; m is 4, 5 or 6; and n is −2, −3 or −4:

(II)

wherein Z represents a group of atoms necessary to form an oxazole nucleus, a benzoxazole nucleus or a naphthooxazole nucleus; $R_1$ represents an optionally substituted alkyl group; $R_2$ represents an alkoxycarbonylalkyl group, a hydroxyalkyl group, a hydroxyalkoxyalkyl group, a carbamoylalkyl group, a hydroxyphenyl group, or a hydroxyalkylphenyl group; and $R_3$ and $R_4$ may be the same or different and each represents a hydrogen atom, an alkyl group, an alkoxy group, an alkylsulfonyl group, a sulfo group, a chlorine atom, a fluorine atom, or a carboxy group.

10 Claims, No Drawings

SILVER HALIDE PHOTOGRAPHIC MATERIAL AND A PROCESSING METHOD FOR THAT MATERIAL

This is a Continuation of application Ser No. 08/040,981 filed Mar. 31, 1993.

FIELD OF THE INVENTION

The present invention relates to a silver halide photographic material, specifically to a silver halide photographic material having a high sensitivity and an excellent rapid processability after exposure with a process camera.

BACKGROUND OF THE INVENTION

In a line photographing process for photo-engraving, an original is made by applying a photocomposing character, a hand written character, an illustration, or a halftone-dotted photograph. This original is photographed with a process camera. The process camera is designed so that the exposure is controlled to a specific exposing time, and a photographic material having a higher sensitivity can be subjected to photographing in a short time.

In recent years, there has been a need to shorten delivery dates in the printing industry, which requires a photographic material having a higher sensitivity. In order to meet this requirement, the sensitizing dyes described in JP-A-55-45015 (the term "JP-A" as used herein means an unexamined published Japanese patent application) have so far been used. Further, it is known from JP-B-48-35373 (the term "JP-B" as used herein means an examined Japanese patent publication) and U.S. Pat. No. 4,835,093 that a higher sensitivity may be obtained by incorporating a metal compound having a cyanide ligand such as potassium hexacyano ferrate (II) into a silver halide grain. However, these metal compounds have the problem that the use thereof in an excessive amount is likely to cause a lowering of contrast. Further, it is known that chemical sensitization with a selenium sensitizer increases sensitivity. However, this sensitization has the defect that the use thereof in an excessive amount is likely to generate a fog.

SUMMARY OF THE INVENTION

One object of the present invention is to provide a silver halide photographic material having a high sensitivity and a hard gradation after exposure with a process camera.

Another object of the present invention is to provide a silver halide photographic material having a high sensitivity and an excellent image quality, even when subjected to rapid processing, and a processing method for that material.

A further object of the present invention is to provide a silver halide photographic material having a high sensitivity and an excellent image quality, even with reduced replenishing amounts of the developing solution and the fixing solution, and a processing method for that material.

These and other objects of the present invention have been achieved by a silver halide photographic material comprising a support having thereon at least one light-sensitive silver halide emulsion layer containing silver halide grains. The sliver halide grains contain a metal compound having a cyanide ligand represented by Formula I and have been subjected to sensitization with a selenium sensitizer and to spectral sensitization with a sensitizing dye represented by Formula II:

$$[M(CN)_mX_{6-m}]^n \quad (I)$$

wherein M represents iron, rhenium, osmium, ruthenium, or iridium; X represents a bridged ligand; m is 4, 5 or 6; and n is −2, −3 or −4:

(II)

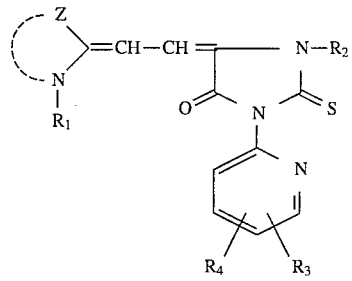

wherein Z represents a group of atoms necessary to form an oxazole nucleus, a benzoxazole nucleus or a naphtho-oxazole nucleus; $R_1$ represents an alkyl group which may have a substituent; $R_2$ represents an alkoxycarbonylalkyl group, a hydroxyalkyl group, a hydroxyalkoxyalkyl group, a carbamoylalkyl group, a hydroxyphenyl group, or a hydroxyalkylphenyl group; and $R_3$ and $R_4$ may be the same or different and each represents a hydrogen atom, an alkyl group, an alkoxy group, an alkylsulfonyl group, a sulfo group, a chlorine atom, a fluorine atom, or a carboxy group.

DETAILED DESCRIPTION OF THE INVENTION

The concrete constitution of the present invention will be explained in detail.

The silver halide photographic emulsion may contain silver chloride, silver bromide, silver bromochloride, silver bromochloroiodide, or silver bromoiodide as the silver halide. The silver chloride content thereof is preferably 30 mole % or more, more preferably 50 mole % or more. The silver iodide content thereof is preferably 5 mole % or less, more preferably 2 mole % or less. The silver halide grains preferably have an average grain size of 0.01 to 1 μm, more preferably 0.15 to 0.4 μm. They have a narrow grain size distribution in which the fluctuation coefficient which is represented by (a standard deviation of the grain sizes/an average grain size)×100, is 15% or less, more preferably 10% or less.

The silver halide grains may comprise either the phase in which the inside and the surface are homogeneous or the phase in which they are different.

The emulsion used in the present invention can be synthesized by the methods described in *Chemie et Physique Photographique* written by P. Glafkides (published by Paul Montel Co., Ltd., 1967), *Photographic Emulsion Chemistry* written by G. F. Duffin (published by The Focal Press Co., Ltd., 1966), and *Making and Coating Photographic Emulsion* written by V. L. Zelikman, (published by The Focal Press Co., Ltd., 1964).

That is, one may use an acid method, a neutral method or an ammonia method. A single jet method, a double jet method or a combination thereof may be used as the method for allowing a water soluble silver salt to react with a water soluble halide. There can be used, as well, the method in which the grains are formed under the presence of excessive silver ions (a so-called reverse mixing method). There can be used as one form of the double jet method, the method in which the pAg of the solution in which the silver halide grains are formed is maintained constant, a so-called controlled double jet method. There can be obtained with this method, a silver halide emulsion having a regular crystal form and an almost uniform grain size.

In order to make uniform a grain size, the silver halide grains are rapidly grown in a range not exceeding the degree of saturation with the method in which the addition speeds of silver nitrate and alkali halide are changed according to the grain growing speed as described in British Patent 1,535,016 and JP-B-49-36890 and JP-B-52-16364 and the method in which the concentration of an aqueous solution is changed as described in British Patent 4,242,445 and JP-A-55-158124.

The grains contained in the silver halide emulsion of the present invention are formed in the presence of a silver halide solvent such as tetrasubstituted thiourea or an organic thioether compound.

The preferred tetrasubstituted thiourea silver halide solvents used in the present invention are the compounds described in JP-A-53-82408 and JP-A-55-77737.

The organic thioether silver halide solvents preferably used in the present invention are the compounds containing at least one group in which an oxygen atom and a sulfur atom are separated by an ethylene group (for example, —O—$CH_2CH_2$—S—) as described in, for example, JP-B-47-11386 (U.S. Pat. No. 3,574,628) and the chain thioether compounds having alkyl groups at both terminals (these alkyl groups each has at least two substituents selected from hydroxy, amino, carboxy, amide and sulfon) as described in JP-A-54-155828 (U.S. Pat. No. 4,276,374).

The addition amount of the silver halide solvent is different according to the kind of compound used, intended grain size and halogen composition. It is preferably $10^{-5}$ to $10^{-2}$ mole per mole of silver halide.

In case the use of the silver halide solvent increases grain size to more than that intended, a desired grain size can be obtained by changing the temperature during the formation of the grains and the addition time of the silver salt solution and halide solution.

The metal compound having a cyanide ligand used in the present invention is represented by Formula I.

Examples of the compound represented by Formula I are listed below:

| | |
|---|---|
| $[Fe(CN)_6]^{-4}$ | $[Fe(CN)_6]^{-3}$ |
| $[Re(CN)_6]^{-2}$ | $[Ru(CN)_6]^{-2}$ |
| $[Os(CN)_6]^{-2}$ | $[Ir(CN)_6]^{-3}$ |
| $[FeF(CN)_5]^{-4}$ | $[FeF(CN)_5]^{-3}$ |
| $[ReF(CN)_5]^{-2}$ | $[RuF(CN)_5]^{-2}$ |
| $[OsF(CN)_5]^{-2}$ | $[IrF(CN)_5]^{-3}$ |
| $[FeCl(CN)_5]^{-4}$ | $[FeCl(CN)_5]^{-3}$ |
| $[ReCl(CN)_5]^{-2}$ | $[RuCl(CN)_5]^{-2}$ |
| $[OsCl(CN)_5]^{-2}$ | $[IrCl(CN)_5]^{-3}$ |
| $[FeBr(CN)_5]^{-4}$ | $[FeBr(CN)_5]^{-3}$ |
| $[ReBr(CN)_5]^{-2}$ | $[RuBr(CN)_5]^{-2}$ |
| $[OsBr(CN)_5]^{-2}$ | $[IrBr(CN)_5]^{-3}$ |
| $[FeI(CN)_5]^{-4}$ | $[FeI(CN)_5]^{-3}$ |
| $[ReI(CN)_5]^{-2}$ | $[RuI(CN)_5]^{-2}$ |
| $[OsI(CN)_5]^{-2}$ | $[IrI(CN)_5]^{-3}$ |
| $[Fe(CN)_5(OCN)]^{-4}$ | $[Ru(CN)_5(OCN)]^{-2}$ |
| $[Os(CN)_5(OCN)]^{-2}$ | $[Fe(CN)_5(SCN)]^{-4}$ |
| $[Ru(CN)_5(SCN)]^{-2}$ | $[Os(CN)_5(SCN)]^{-2}$ |
| $[Fe(CN)_5(N_3)]^{-4}$ | $[Ru(CN)_5(N_3)]^{-2}$ |
| $[Os(CN)_5(N_3)]^{-2}$ | $[Fe(CN)_5(H_2O)]^{-3}$ |
| $[Ru(CN)_5(H_2O)]^{-1}$ | $[Os(CN)_5(H_2O)]^{-1}$ |
| $[RuF_2(CN)_4]^{-2}$ | $[OsF_2(CN)_4]^{-2}$ |
| $[FeCl_2(CN)_4]^{-2}$ | $[FeCl_2(CN)_4]^{-2}$ |
| $[IrBr_2(CN)_4]^{-3}$ | $(RuBr_2(CN)_4]^{-2}$ |
| $[OsI_2(CN)_4]^{-2}$ | $[ReI_2(CN)_4]^{-2}$ |

The above compounds are preferably added during the formation of the silver halide grains. With respect to the addition time thereof, they may be uniformly distributed in the grains or may be locally present in the grains by adding them at the initial, middle or latter period of grain formation. They are added preferably at the latter period of the grain formation, that is, after 50%, more preferably 80%, of the final grain size has been formed.

The addition amount of the above compounds is suitably $1\times10^{-7}$ to $1\times10^{-2}$ mole, preferably $1\times10^{-6}$ to $1\times10^{-3}$ mole, and more preferably $5\times10^{-6}$ to $1\times10^{-4}$ mole, per mole of silver halide finally formed.

In the present invention, compounds of metals having no cyanide ligand and belonging to the VIII Group can be used in addition to the above compounds. In particular, the combined use with a rhodium salt such as potassium hexachlororhodate(III) and potassium hexabromorhodate (III) and an iridium salt such as ammonium hexachloroiridate(III) and iridium chloride is advantageous since an emulsion having a harder gradation can be obtained.

The selenium compounds disclosed in the published patents can be used as the selenium sensitizer used in the present invention. That is, an unstable type selenium compound and/or non-unstable type selenium compound are usually added and used by stirring an emulsion at an elevated temperature, preferably at 40° C. or higher, for a fixed time. There are preferably used as the unstable selenium compound, the compounds described in JP-B-44-15748 and JP-B-43-13489, and JP-A-4-25832 and JP-A-4-109204. There can be given as examples of the unstable selenium compound, which are not limited, isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacylselenides (for example, bis(3-chloro-2,6-dimethoxybenzoyl)selenide), selenophosphates, phosphineselenides, and colloidal metal selenium.

With the unstable selenium compound as the sensitizer for a photographic emulsion, the structure of the compound is not important for the person of an ordinary skill in the art, as long as selenium is unstable. It is generally understood that the organic portion of a selenium sensitizer molecule has no function other than to carry selenium and allow it to be present in an emulsion in an unstable form. In the present invention, the unstable selenium compounds having such a broad definition are advantageously used.

There are used as the non-unstable selenium compound in the present invention, the compounds described in JP-B-46-4553, JP-B-52-34492 and JP-B-52-34491. There can be given as examples of the non-unstable selenium compound, selenious acid, potassium selenocyanide, selenazoles, quaternary salts of selenazoles, diaryl selenide, diaryl diselenide, dialkyl selenide, dialkyl diselenide, 2-selenazilidinedione, 2-selenoxazolidinethione, and the derivatives thereof.

Of these selenium compounds, the compounds represented by the following Formulas III and IV are preferred:

$$Z_1-\overset{\overset{\displaystyle Se}{\|}}{C}-Z_2 \qquad \text{(III)}$$

wherein $Z_1$ and $Z_2$ may be the same or different and each represents an alkyl group (for example, methyl, ethyl, t-butyl, adamantyl, and t-octyl), an alkenyl group (for example, vinyl and propenyl), an aralkyl group (for example, benzyl and phenetyl), an aryl group (for example, phenyl, pentafluorophenyl, 4-chlorophenyl, 3-nitrophenyl, 4-octylsulfamoylphenyl, and α-naphthyl), a heterocyclic group (for example, pyridyl, thienyl, furyl, and imidazolyl), —$NR_1(R_2)$, —$OR_3$, or —$SR_4$.

$R_1$, $R_2$, $R_3$, and $R_4$ may be the same or different and each represents an alkyl group, an aralkyl group, an aryl group, or a heterocyclic group. The same examples as those enumerated for $Z_1$ can be given for this alkyl, aralkyl, aryl, and heterocyclic group.

Additionally, $R_1$ and $R_2$ each may be a hydrogen atom or an acyl group (for example, acetyl, propanoyl, benzoyl, heptafluorobutanoyl, difluoroacetyl, 4-nitrobenzoyl, α-naphthoyl, and 4-trifluoromethylbenzoyl).

In Formula III, $Z_1$ represents preferably an alkyl group, an aryl group, or —$NR_1(R_2)$ and $Z_2$ represents preferably —$NR_5(R_6)$. Here $R_1$ and $R_2$ are as defined above, and $R_5$ and $R_6$ may be the same or different and each represents a hydrogen atom, an alkyl group, an aryl group, or an acyl group.

Of the compounds represented by Formula III, preferred are N,N-dialylselenourea, N,N,N'-trialkyl-N'-acylselenourea, tetralkylselenourea, N,N-dialkyl-arylselenoamide, and N-alkyl-N-aryl-arylselenoamide.

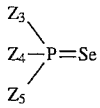

(IV)

wherein $Z_3$, $Z_4$ and $Z_5$ may be the same or different and each represents an aliphatic group, an aromatic group, a heterocyclic group, —$OR_7$, —$NR_8(R_9)$, —$SR_{10}$, —$SeR_{11}$, X, or a hydrogen atom.

$R_7$, $R_{10}$ and $R_{11}$ each represents an aliphatic group, an aromatic group, a heterocyclic group, a hydrogen atom, or a cation; and $R_8$ and $R_9$ each represents an aliphatic group, an aromatic group, a heterocyclic group, or a hydrogen atom; and X represents a halogen atom.

In Formula IV, the aliphatic group represented by $Z_3$, $Z_4$, $Z_5$, $R_7$, $R_8$, $R_9$, $R_{10}$ and $R_{11}$ is a linear, branched or cyclic alkyl group, alkenyl group, alkynyl group, aralkyl group (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenethyl).

In Formula IV, the aromatic group represented by $Z_3$, $Z_4$, $Z_5$, $R_7$, $R_8$, $R_9$, $R_{10}$ and $R_{11}$ represents a monocyclic or condensed aryl group (for example, phenyl, pentafluorophenyl, 4-chlorophenyl, 3-sulfophenyl, α-naphthyl, and 4-methylphenyl).

In Formula IV, the heterocyclic group represented by $Z_3$, $Z_4$, $Z_5$, $R_7$, $R_8$, $R_9$, $R_{10}$ and $R_{11}$ represents a 3- to 10-membered saturated or unsaturated heterocyclic group containing at least one nitrogen atom, oxygen atom or sulfur atom (for example, pyridyl, thienyl, furyl, thiazolyl, imidazolyl, and benzimidazolyl).

In Formula IV, the cation represented by $R_7$, $R_{10}$ and $R_{11}$ represents an alkali metal atom or ammonium. The halogen atom represented by X represents, for example, a fluorine atom, a chlorine atom, a bromine atom, or an iodine atom.

In Formula IV, $Z_3$, $Z_4$, or $Z_5$ represents preferably an aliphatic group, an aromatic group, or —$OR_7$, and $R_7$ represents preferably an aliphatic group or an aromatic group.

Of the compounds represented by Formula IV, preferred are trialkyl phosphineselenide, triaryl phosphineselenide, trialkyl selenophosphate, or triaryl selenophosphate.

Examples of the compounds represented by Formulas III and IV are shown below, but the present invention is not limited thereto:

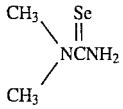

III-1

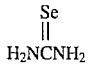

III-2

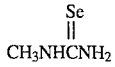

III-3

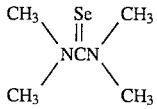

III-4

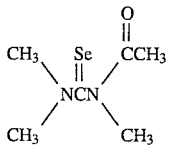

III-5

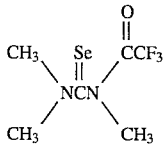

III-6

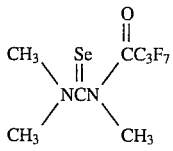

III-7

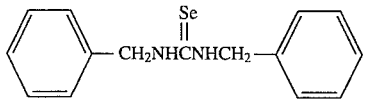

III-8

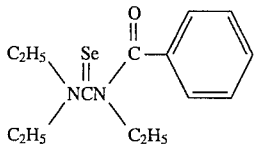

III-9

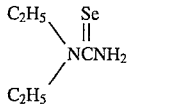

III-10

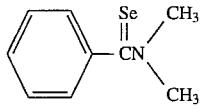

III-11

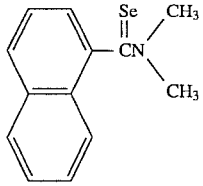

III-12

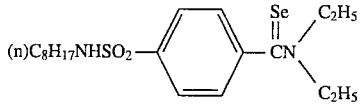

III-13

-continued

III-14

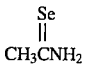

III-15

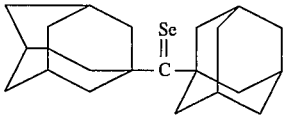

III-16

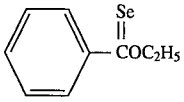

III-17

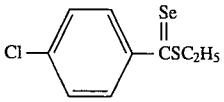

III-18

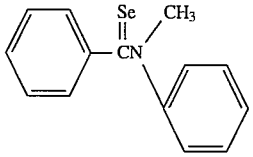

III-19

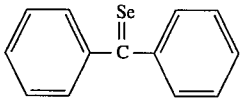

III-20

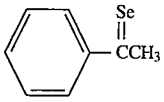

IV-1

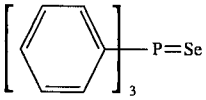

IV-2

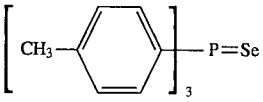

IV-3

$(nC_4H_9)_3P{=}Se$

IV-4

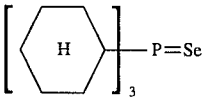

IV-5

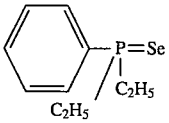

IV-6

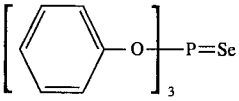

IV-7

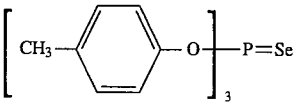

IV-8

$(nC_4H_9O)_3P{=}Se$

-continued

IV-9

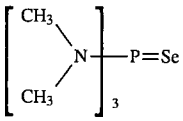

IV-10

$(C_2H_5O)_3P{=}Se$

IV-11

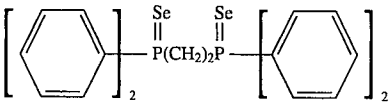

IV-12

$(nC_8H_{17})_3P{=}Se$

IV-13

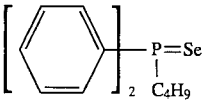

IV-14

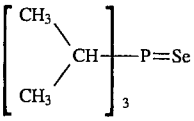

IV-15

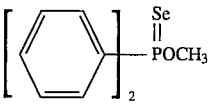

IV-16

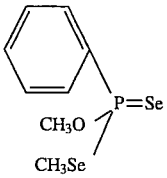

IV-17

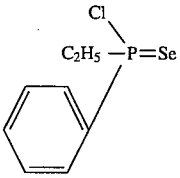

IV-18

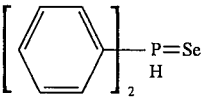

IV-19

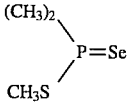

Selenium sensitizing methods are disclosed in U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491, JP-B-52-34492, JP-B-53-295, and JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, JP-A-3-4221, JP-A-3-148648, JP-A-3-11838, JP-A-3-116132, JP-A-3-237450, JP-A-4-25832, JP-A-4-32831, and JP-A-4-109240, and Japanese Patent Application No. 2-110558, British Patents 255,846 and 861,984, and *Journal of Photographic Science* written by H. E. Spencer et al, vol. 31, pp. 158 to 169 (1983).

These selenium sensitizers are used in a chemical sensitization by dissolving them in a single or mixed solvent of water or an organic solvent such as methanol and ethanol or in the forms described in JP-A-4-140738 and JP-A-4-140739. They are added preferably before starting the chemical sensitization. The selenium sensitizer to be a not limited to a single kind and can be a combination of two or more of the above selenium sensitizers. The unstable selenium compound and non-unstable selenium compound may be used in combination.

The addition amount of the selenium sensitizer used in the present invention is different according to the activity of the selenium sensitizer used, the kind and size of the silver halide grain, and the temperature and time of ripening. It is preferably $1\times10^{-8}$ mole or more, more preferably $1\times10^{-7}$ or more and $1\times10^{-5}$ or less, per mole of silver halide. The temperature for chemical ripening in using the selenium sensitizer is preferably 45° C. or more, more preferably 50° C. or more and 80° C. or less. The pH and pAg figure are arbitrary. The effects of the present invention can be obtained over a broad pH range of, for example, 4 to 9.

Selenium sensitization is more effectively carried out in the presence of a silver halide solvent.

There can be given as the silver halide solvent used in the present invention, (a) organic thioethers described in U.S. Pat. Nos. 3,271,157, 3,531,289, and 3,574,628, and JP-A-54-1019 and JP-A-54-158917, (b) thiourea derivatives described in JP-A-53-82408, JP-A-55-77737, and JP-A-55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites, and (f) thiocyanates.

Thiocyanate and tetramethylthiourea are particularly preferred solvents. The amount of the solvent used is different by kind. For example, in the case of thiocyanate, the preferred amount thereof is $1\times10^{-4}$ or more and $1\times10^{-2}$ or less per mole of silver halide.

The silver halide photographic emulsion according to the present invention can achieve a high sensitivity and a low fog by using sulfur sensitization and/or a gold sensitization in combination with chemical sensitization.

Sulfur sensitization is usually carried out by adding a sulfur sensitizer to an emulsion and stirring the emulsion at a high temperature, preferably 40° C. or higher, for a fixed time.

Also, gold sensitization is usually carried out by adding a gold sensitizer to an emulsion and stirring the emulsion at a high temperature, preferably 40° C. or higher, for a fixed time.

The compounds publicly known as sulfur sensitizers can be used for the above sulfur sensitization. There can be given, for example, thiosulfates, thioureas, allylisothiacyanate, cystine, p-toluenethiosulfonate, and rhodanine. In addition thereto, there can be used the sulfur sensitizers described in U.S. Pat. Nos. 1,574,944, 2,410,689, 2,278,947, 2,728,668, 3,501,313, and 3,656,955, German Patent 1,422,869, and JP-B-56-24937, JP-A-55-45016.

The addition amount of the sulfur sensitizer may be an amount sufficient for effectively increasing the sensitivity of the emulsion. This amount is varied to a considerably broad extent and is preferably $1\times10^{-7}$ mole or more and $5\times10^{-4}$ mole or less per mole of silver halide.

In the gold sensitizer for the above gold sensitization, the oxidation number of gold may be +1 valency or +3 valency, and the gold compounds usually used as a gold sensitizer can be used. There can be given as representative examples thereof, chlorauric acid, potassium chloraurate, auric trichloride, potassium auric thiocyanate, potassium iodoaurate, tetracyanoauric acid, ammonium aurothiocyanate, and pyridyl trichlorogold.

The addition amount of the gold sensitizer is different according to various conditions. As a standard, it is preferably $1\times10^{-7}$ mole or more and $5\times10^{-4}$ mole or less per mole of silver halide.

It is not necessary to specifically limit the addition time and order of the sulfur sensitizer and/or gold sensitizer which can be used in combination with the silver halide solvent and selenium sensitizer or with the selenium sensitizer in the chemical sensitization. The above compounds can be added simultaneously or at the different addition time, for example, preferably at the beginning of chemical ripening or during chemical ripening. In adding them, the above compounds may be dissolved in a single or mixed solution of water or an organic solvent such as, for example, methanol, ethanol and acetone.

The light-sensitive silver halide emulsion according to the present invention is subjected to orthochromatic sensitization with the sensitizing dye represented by Formula II.

In Formula II, Z represents the group of atoms necessary for forming an oxazole nucleus, a benzoxazole nucleus, or a naphthoxazole nucleus. The benzoxazole nucleus is preferred. These nuclei may have substituents on the carbon atoms. There can be given as examples of the substituent, a halogen atom (for example, fluorine atom, chlorine atom, and bromine atom), an unsubstituted alkyl group having a carbon number of 1 to 6 (for example, methyl, ethyl, propyl, butyl, and hexyl), an alkoxy group having a carbon number of 1 to 4 (for example, methoxy, ethoxy, propoxy, and butoxy), a hydroxy group, an alkoxycarbonyl group having a carbon number of 2 to 6 (for example, methoxycarbonyl and ethoxycarbonyl), an alkylcarbonyloxy group having a carbon number of 2 to 5 (for example, acetyloxy and propionyloxy), a phenyl group, and a hydroxyphenyl group.

There can be given as examples of these nuclei, the nuclei including as the oxazole nucleus, oxazole, 4-methyloxazole, 5-methyloxazole, 4,5-dimethyloxazole, and 4-phenyloxazole; as the benzoxazole nucleus, benzoxazole, 5-chlorobenzoxazole, 5-bromobenzoxazole, 5-methylbenzoxazole, 5-ethylbenzoxazole, 5-methoxybenzoxazole, 5-hydroxybenzoxazole, 5-ethoxycarbonylbenzoxazole, 5-acetyloxybenzoxazole, 5-phenylbenzoxazole, 6-methylbenzoxazole, 6-methoxybenzoxazole, 5,6-dimethylbenzoxazole, and 6-chloro-5-methylbenzoxazole; and as the naphthoxazole nucleus, naphtho[1,2-d]oxazole, naphtho[2,1-d]oxazole, and naphtho[2,3-d]oxazole.

$R_1$ represents an unsubstituted or substituted alkyl group having a total carbon number (hereinafter "the carbon number" means a total carbon number) of 1 to 10. There can be given as examples of the substituents, a hydroxy group, a sulfo group, a sulfate group, a carboxy group, a halogen atom (for example, a fluorine atom and a chlorine atom), an unsubstituted or substituted alkoxy group having a carbon number of 1 to 4 (the alkoxy group may further be substituted with a sulfo group or a hydroxy group), an alkoxycarbonyl group having a carbon number of 2 to 5, an alkylsulfonyl group having a carbon number of 1 to 4, a sulfamoyl group, an unsubstituted or substituted carbamoyl group (including carbamoyl group substituted with an alkyl group having a carbon number of 1 to 4), a substituted phenyl group (as examples of the substituent, a sulfo group, a carboxy group, and a hydroxy group), and a vinyl group.

There can be given as examples of the unsubstituted alkyl group, methyl, ethyl, propyl, and butyl. There can be given as examples of the substituted alkyl group, hydroxyalkyl group, 2-hydroxyethyl and 3-hydroxypropyl, as a sulfoalkyl group, 2-sulfoethyl, 3-sulfopropyl, 3-sulfobutyl, 4-sulfobutyl, 2-hydroxy-3-sulfopropyl, and 2-chloro-3-sulfopropyl, 2-sulfatoethyl, 3-sulfatopropyl, as a carboxyalkyl group, carboxymethyl, carboxyethyl, and carboxypropyl, 2,2,2-trifluoroethyl, 2-(3-sulfopropyloxy)ethyl, 2-(2-hydroxyethoxy)ethyl, ethoxycarbonylethyl, methylsulfonylethyl, as a sulfamoylalky group, 2-sulfamoylethyl, as a carbamoylethyl group 2-carbamoylethyl, and 2-N,N-dimethylcarbamoylethyl phenethyl, p-carboxyphenethyl, as a sulfoaralkyl group, p-sulfophenethyl and o-sulfophenethyl, p-hydroxyphenethyl, allyl, and phenoxyethyl.

$R_2$ represents an alkoxycarbonylalkyl group having a carbon number of 3 to 7 (for example, methoxycarbonylmethyl, ethoxycarbonylmethyl, and ethoxycarbonylethyl), a hydroxyalkyl group having a carbon number of 1 to 4 (for example, 2-hydroxyethyl, 2-hydroxypropyl, 3-hydroxypropyl, and 2,3-dihydroxypropyl), a hydroxyalkoxyalkyl group having a carbon number of 2 to 6 (for example, hydroxymethoxymethyl, 2-(2-hydroxyethoxy) ethyl, and 2-hydroxyethoxymethyl), a carbamoylalkyl group having a carbon number of 2 to 8 (including an N-alkyl substituted-, N,N-dialkyl substituted-, N-hydroxyalkyl substituted-, N-alkyl-N-hydroxyalkyl substituted-, and N,N-di(hydroxyalkyl) substituted-carbamoylalkyl group, and carbamoylalkyl group of a 5- or 6-membered cyclic amine) (for example, 2-carbamoylethyl, 2-N-(2-hydroxyethyl)carbamoylethyl, N-hydroxyethylcarbamoylmethyl, 2-N,N-di(2-hydroxyethyl) carbamoylmethyl, N,N-dimethylcarbamoylmethyl, morpholinocarbamoylmethyl, and piperidinocarbamoylmethyl), a hydroxyphenyl group, a hydroxyalkylphenyl group having a carbon number of 7 to 9 (for example, p-(2-hydroxyethyl)phenyl and m-(1hydroxyethyl)phenyl).

$R_3$ and $R_4$ may be the same or different and each represents a hydrogen atom, an alkyl group having a carbon number of 1 to 4 (for example, methyl and ethyl), an alkoxy group having a carbon number of 1 to 4 (for example, methoxy and ethoxy), a chlorine atom, or a carboxy group.

Representative examples of the compounds used in the present invention represented by the above Formula II are shown below, but the compounds used in the present invention are not limited thereto.

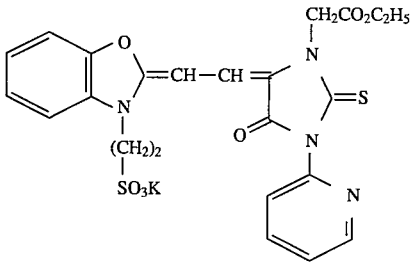

II-1

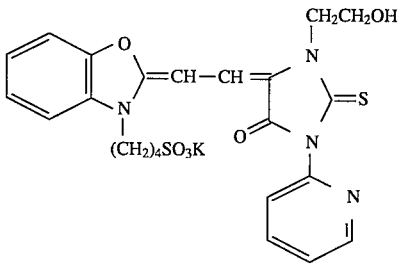

II-2

-continued

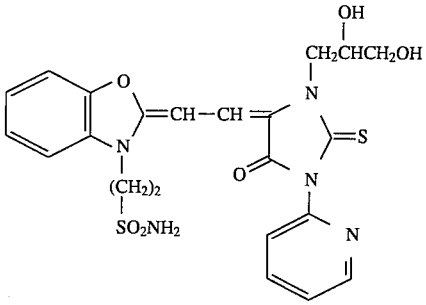

II-3

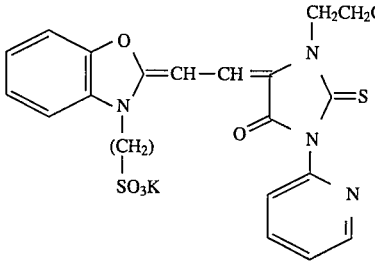

II-4

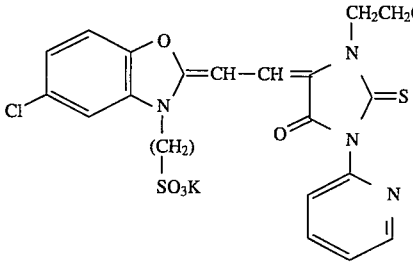

II-5

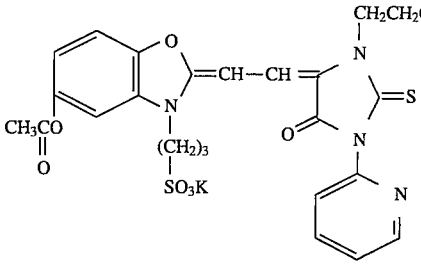

II-6

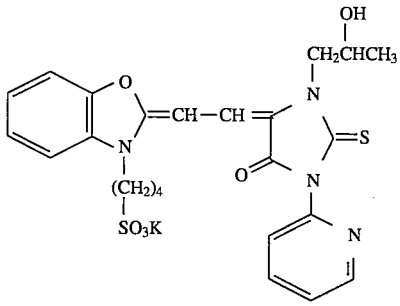

II-7

-continued
II-8
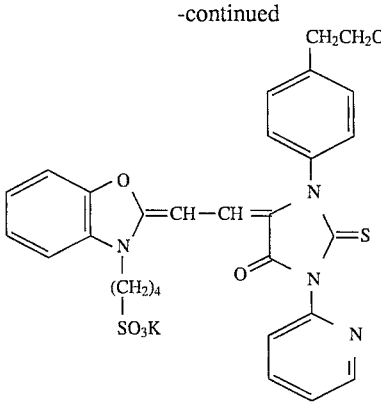
II-9
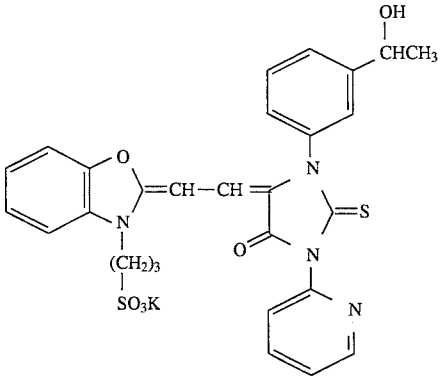
II-10
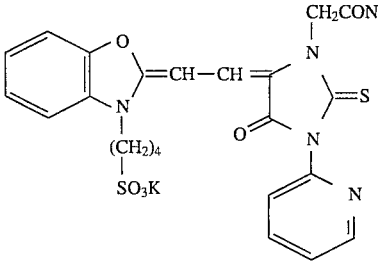
II-11
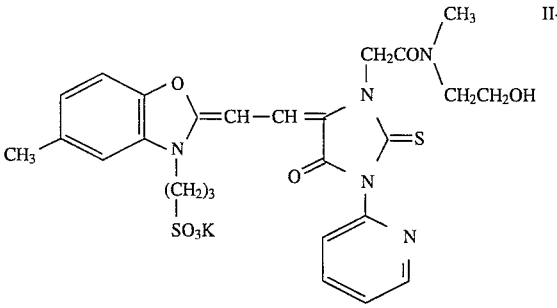
II-12
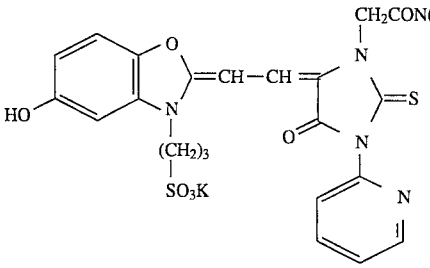
-continued
II-13
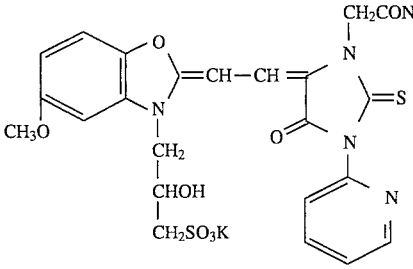
II-14
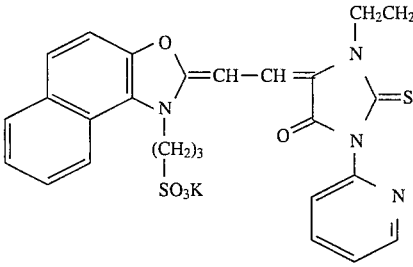
II-15
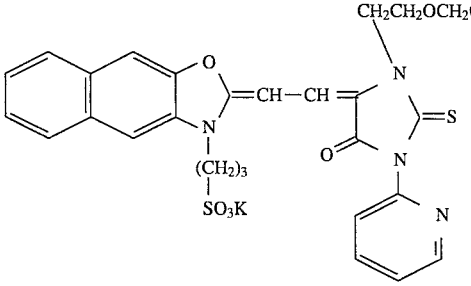
II-16
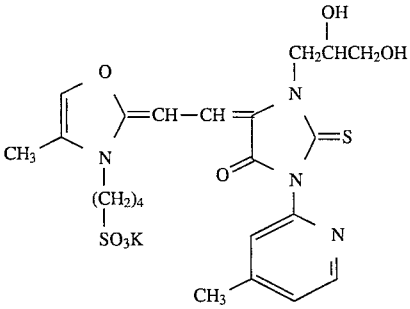
II-17
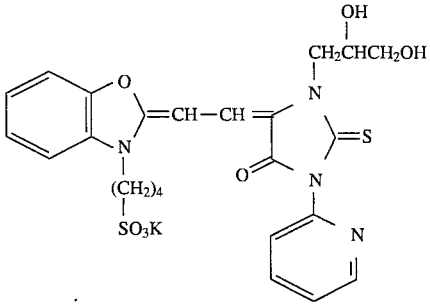

-continued

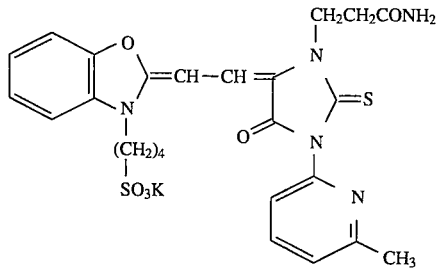

II-18

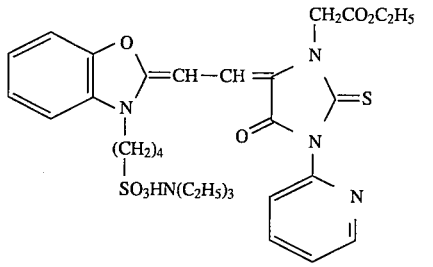

II-19

Regarding the content of the sensitizing dye according to the present invention, the optimum amount thereof is desirably selected according to the grain size of the silver halide emulsion, the halogen composition, the method and degree of chemical sensitization, the relationship of the layer into which the above compound is incorporated with a silver halide emulsion, and the kind of anti-fogging agent. The test method for the selection thereof is known well for the person of an ordinary skill in the art. Usually, it is used preferably in the range of $10^{-7}$ to $1\times10^{-2}$ mole, particularly $10^{-6}$ to $5\times10^{-3}$ mole, per mole of silver halide.

Various additives used for the light-sensitive material according to the present invention are not specifically limited, and those described in, for example, the corresponding portions shown below can preferably be used:

| Item | Corresponding portion |
|---|---|
| 1) Surface active agent, & anti-static agent | Right upper column, line 7 to right lower column line 7 of JP-A-2-12236, and left lower column, line 13 at p. 2 to right lower column, line 18 at p. 4 of JP-A-2-18542. |
| 2) Anti-fogging agent, & stabilizer | Right lower column, line 19 at p. 17 to right upper column, line 4, at p. 18 and right lower column, lines 1 to 5 of JP-A-2-103536. |
| 3) Polymer latex | Left lower column lines 12 to 20 at p. 18 of JP-A-2-103536. |
| 4) Compound having an acid group | Right lower column, line 6 at p. 18 to left upper column, line 1 at p. 19 of JP-A-2-103536, and right lower column, line 13 at p. 8 to left upper column, line 8 at p. 11 of JP-A-2-55349. |
| 5) Polyhydroxy-benzenes | Left upper column, line 9 to right lower column, line 17 at p. 11 of JP-A-2-55349. |
| 6) Matting agent, sliding agent, & plasticizer | Left upper column, line 15 to right upper column, line 15 at p. 19 of JP-A-2-103536. |
| 7) Hardener | Right upper column, lines 5 to 17 at p. 18 of JP-A-2-103536. |
| 8) Dye | Right lower column, lines 1 to 18 at p. 17 of JP-A-2-103536, and right upper column, line 1 at p. 4 to right upper column, line 5 at p. 6 of JP-A-2-39042. |
| 9) Binder | Right lower column, lines 1 to 20 at p. 3 of JP-A-2-18542. |
| 10) Developing solution and developing method | Right lower column, line 1 to left upper column, line 10 at p. 13 of JP-A-2-55349. |

The developing method of the present invention are described in more detail as follows.

Examples of 1-phenyl-3-pyrazolidone and derivatives thereof which can be used as the developing agents with the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl- 3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Examples of the p-aminophenol developing agents which can be used with the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Among these, N-methyl-p-aminophenol is particularly preferred.

The developing agents are used in an amount of preferably 0.05 to 0.8 mol/l. When the dihydroxybenzenes are used in combination with the 1-phenyl-3-pyrazolidones or the p-aminophenols, it is preferred that the former is used in an amount of 0.05 to 0.5 mol/l and the latter is used in an amount of not more than 0.06 mol/l.

Examples of sulfites which can be used as preservatives in the present invention include sodium sulfite, potassium sulfite, lithium sulfite, ammonium sulfite, sodium bisulfite, potassium metabisulfite and formaldehyde-sodium bisulfite adduct. The sulfites are used in an amount of preferably at least 0.3 mol/l, particularly at least 0.4 mol/l. The upper limit is preferably 2.5 mol/l, particularly preferably 1.2 mol/l.

Examples of alkaline agents which can be used to set pH include pH adjustors or buffering agents such as sodium hydroxide, potassium hydroxide, sodium carbonate, potassium carbonate, sodium tertiary phosphate, potassium tertiary phosphate, sodium silicate and potassium silicate.

Examples of other additives which can be used in addition to the above components in the present invention include a development inhibitor compounds such as boric acid and borax, sodium bromide, potassium bromide and potassium iodide; organic solvents such as ethylene glycol, diethylene glycol, triethylene glycol, dimethylformamide, methyl cellosolve, hexylene glycol, ethanol and methanol; and anti-fogging agents such as mercapto compounds (e.g., 1-phenyl-5-meroaptotetrazole, sodium 2-mercaptobenzimidazole-5-sulfonate), indazole compounds (e.g., 5-nitroindazole) and benztriazole compounds (e.g., 5-methylbenztriazole). If desired, the developing solutions may contain a toning agent, a surfactant, an anti-foaming agent, a hard water softener, a hardening agent, etc. The amino compounds described in JP-A-56-106244 and imidazole compounds described in JP-B-48-35493 are particularly preferred from the viewpoint of accelerating development or increasing sensitivity.

The developing solutions of the present invention may contain the silver stain inhibitors described in JP-A-56-24347, the uneven development inhibitors described in JP-A-62-212651 and the dissolution aids described in JP-A-61-267759.

The developing solutions of the present invention may contain, as buffering agents, boric acids described in JP-A-62-186259 and the saccharides (e.g., saccharose), oximes (e.g., acetoxime), phenols (e.g., 5-sulfosalicylic acid) and tertiary phosphates (e.g., sodium salt, potassium salt) described in JP-A-60-93433. Among these, boric acid are preferred as buffering agents.

The fixing solution is an aqueous solution containing a fixing agent and optionally a hardening agent (e.g., a water-soluble aluminum compound), acetic acid and a dibasic acid (e.g., tartaric acid, citric acid or a salt thereof) and having a pH of preferably not lower than 3.8, more preferably 4.0 to 5.5.

Examples of the fixing agent include sodium thio sulfate and ammonium thiosulfate. Ammonium thiosulfate is particularly preferred from the viewpoint of its rate of fixing. The amount of the fixing agent can be varied and is generally about 0.1 to 5 mol/l.

Water-soluble ammonium salts which mainly function as hardening agents in the fixing solution are compounds generally known as hardening agents in hardening acid fixers. Examples thereof include aluminum chloride, aluminum sulfate and potash alum.

The above-described dibasic acids include tartaric acid and derivatives thereof and citric acid and derivatives thereof, either singly or a combination of two or more. An effective amount of the dibasic acid used is at least 0.005 mol per liter of the fixing solution, and preferably 0.01 to 0.03 mol per liter of the fixing solution.

Concrete examples of the tartaric acid compounds include tartaric acid, potassium tartrate, sodium tartrate, potassium sodium tartrate, ammonium tartrate and ammonium potassium tartrate.

Examples of the citric acid and derivatives thereof which can be effectively used in the present invention include citric acid, sodium citrate and potassium citrate.

The fixing solution m,may optionally contain preservatives (e.g., sulfites, bisulfites), pH buffering agents (e.g., acetic acid, boric acid), pH adjustors (e.g., ammonia, sulfuric acid), image storage improvers (e.g., potassium iodide) and chelating agents. The pH buffering agents are used in an amount of preferably 10 to 40 g/l, more preferably 18 to 25 g/l, because the pH of the developing solution is high.

The fixing temperature and time are preferably about 20° to about 50° C. for 10 seconds to one minute as in the development stage.

After development and fixing, the photographic material is washed with water and dried. Rinsing is carried out to remove almost completely the silver salt dissolved by fixing. Rinsing water may contain antimolding agents (e.g., the compound described in Horiguchi, *Antibacterial and Antifungal Chemistry* and JP-A-62-115154), rinsing accelerators (e.g., sulfites) and chelating agents. Preferably, rinsing is carried out at a temperature of about 20° to about 50° C. for 10 seconds to 3 minutes.

Drying is carried out at a temperature of about 40° to about 100° C. The drying time varies depending on circumferential conditions, but is generally about 40° C. to 80° C. for 5 seconds to 3 minutes.

The photographic material of the present invention shows an excellent performance in a high speed automatic developing processor for 15 to 60 seconds processing time.

In the high speed automatic processor of the present invention, a processing time and temperature in a developing and fixing steps are 25 seconds or less at 25° to 50° C., preferably 4 to 15 seconds at 30° to 40° C.

A total processing time discussed in the present invention means a total cumulative time from introducing a tip of the film at an inlet of the processor to an outlet through a developing bath, a cross-over, a fixing bath, a cross-over, a washing bath, a cross-over and a drying part, continuously.

Roller convey type automatic processors are described in U.S. Pat. Nos. 3,025,779 and 3,545,971 and are referred to herein simply as roller convey type processor. The roller convey type processor comprises the four stages of development, fixing, rinsing and drying. In the present invention, the four stage processing is most preferred, though other stages (e.g., a stop stage) may be optionally added with the present invention. A rinsing stage can be carried out in a water saving manner when a two or three stage counter-current system is used.

It is preferred that the developing solutions of the present invention are stored in a packaging container having a low oxygen permeability as described in JP-A-61-73147. A replenishment system described in JP-A-62-91939 can be preferably used for the developing solutions of the present invention.

The silver halide photographic material of the present invention gives a high Dmax. Accordingly, when the photographic material of the present invention is subjected to a reduction treatment, a high density can be retained even if dot area is reduced.

Any of reducers described in Meeds, *The Theory of the Photographic Process*, pp. 738–744 (1954 Macmillan), Tetsuo Yano, *Theory and Practice of Photographic Processing*, pp. 166–169, (1978 Kyoritsu Shuppan), JP-A-50-27543, JP-A-52-68429, JP-A-55-17123, JP-A-55-79444, JP-A-57-10140, JP-A-57-142639 and JP-A-61-61155 can be used without particular limitation. Specific examples of the reducers include: reducers containing permanganates, persulfates, ferric salts, cupric salts, ceric salts, red prussiate of potash and dichromates as oxidizing agents either singly or in combination and optionally inorganic acids such as sulfuric acid and alcohols; and reducers containing oxidizing agents such as red prussiate of potash or ethylenediaminertetraacetato ferrate (III), solvents for silver halide such as thiosulfates, rhodanides, thiourea or derivatives thereof and optionally inorganic acids such as sulfuric acid.

Typical examples of the reducers which can be used in the present invention include Farmer's reducer, ethylenediaminetetraacetato ferrate (III), potassium permanganate, ammonium persulfate reducers (Kodak R5) and ceric salt reducer.

Reduction processing is generally carried out at a temperature of 10° to 40° C., preferably 15° to 30° C., and preferably completed within several seconds to several tens of minutes (particularly preferably within several minutes).

The examples will be presented below to explain the present invention in more detail.

EXAMPLE 1

| Preparation of Emulsion A | |
|---|---|
| Solution 1: | |
| Water | 1.0 liter |
| Gelatin | 20 g |
| Sodium chloride | 35 g |
| 1,3-Dimethylimidazolidine-2-thione | 20 mg |
| Sodium benzenesulfonate | 6 mg |
| Solution 2: | |
| Water | 400 ml |
| Silver nitrate | 100 g |
| Solution 3: | |
| Water | 400 ml |
| Sodium chloride | 27.1 g |
| Potassium bromide | 21.0 g |
| Potassium hexachloroiridate (III) (0.001% aqueous solution) | 5 ml |
| Potassium hexachlororhodate (III) (0.001% aqueous solution) | 5 ml |

Solution 2 and Solution 3 were simultaneously added to Solution 1 maintained at 40° C. and pH 4.5 over a period of 15 minutes during Stirring to form a nuclear grain of 0.20 μm. Subsequently, the following Solution 4 and Solution 5 were added over a period of 15 minutes. Further, potassium iodide 0.15 g was added to finish the grain formation.

| Solution 4: | |
|---|---|
| Water | 400 ml |
| Silver nitrate | 100 g |
| Solution 5: | |
| Water | 400 ml |
| Sodium chloride | 27.1 g |
| Potassium bromide | 21.0 g |
| Compound shown in Table 1 (amount shown in Table 1) | |

Subsequently, the emulsion thus prepared was washed by a conventional flocculation method and gelatin in the amount of 30 g was added.

This emulsion was divided into two parts. One emulsion part was adjusted to pH of 5.5 and pAg of 7.5, and sodium thiosulfate (3.7 mg) and chlorauric acid (6.2 mg) were added thereto at 65° C., whereby it was subjected to chemical sensitization to an optimum sensitization.

The other emulsion part was adjusted to pH of 5.3 and pAg of 7.5, and there were added thereto, sodium thiosulfate (2.0 mg), the selenium sensitizer IV-1 (3.0 mg), chlorauric acid (6 mg), sodium benzenethiosulfonate (4 mg), and sodium benzenesulfinate (1 mg) at 55° C., whereby it was subjected to chemical sensitization to an optimum sensitization. Then, there were added 4-hydroxy-6-methyl-1,3,3a,7-tetrazaindene (200 mg) as a stabilizer, and phenoxyethanol as an antiseptic agent, whereby there was obtained a silver bromochloroiodide cubic emulsion finally containing silver chloride of 70 mole % and having an average grain size of 0.25 μm. (Fluctuation coefficient: 9%).

Preparation of the coated sample

The sensitizing dyes of Formula II identified in Table 1 were added to Emulsion A in the amount of $1\times10^{-3}$ mole/mole Ag to subject it to a spectral sensitization. There were further added hydroquinone and 1-phenyl-5-mercaptotetrazole as an anti-fogging agent in the amounts of 1.5 g and 50 mg, respectively, a polyethyl acrylate latex as a plasticizer in a ratio of 25% based on the gelatin binder, colloidal silica with a grain size of 10 μm in a ratio of 40% based on the gelatin binder, and 2-bis(vinylsulfonylacetamide) ethane as a hardener. The solution thus prepared was coated on a polyester support in amounts of Ag (3.5 g/m$^2$) and gelatin (1.5 g/m$^2$). A lower protective layer and an upper protective layer, each having the following compositions, were coated thereon.

| Lower protective layer: | |
|---|---|
| Gelatin | 0.25 g/m$^2$ |
| Sodium benzenethiosulfonate | 4 mg/m$^2$ |
| 1,5-Dihydroxy-2-benzaldoxime | 25 mg/m$^2$ |
| Polyethyl acrylate latex | 125 mg/m$^2$ |
| Upper protective layer: | |
| Gelatin | 0.25 g/m$^2$ |
| Matting agent with an average size of 3.4 μm | 100 mg/m$^2$ |

-continued

| | |
|---|---|
| Compound (1) (gelatin dispersion) | 30 mg/m$^2$ |
| Compound (2) | 5 mg/m$^2$ |
| Sodium dodecylbenzenesulfonate | 22 mg/m$^2$ |

The support used for the samples in the examples had a back layer and a back protective layer, each having the following composition:

| Back layer: | |
|---|---|
| Gelatin | 2.0 g/m$^2$ |
| Sodium dodecylbenzenesulfonate | 80 mg/m$^2$ |
| Compound (3) | 60 mg/m$^2$ |
| Compound (4) | 50 mg/m$^2$ |
| Compound (5) | 50 mg/m$^2$ |
| 1,3-Divinylsulfonyl-2-propanol | 60 mg/m$^2$ |
| Back protective layer: | |
| Gelatin | 0.5 g/m$^2$ |
| Polymethyl methacrylate (grain size: 4.7 μm) | 30 mg/m$^2$ |
| Sodium dodecylbenzenesulfonate | 20 mg/m$^2$ |
| Compound (2) | 2 mg/m$^2$ |
| Silicone oil | 100 mg/m$^2$ |

Compound (1)

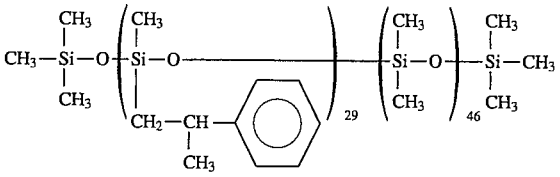

Compound (2)

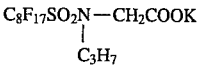

Compound (3)

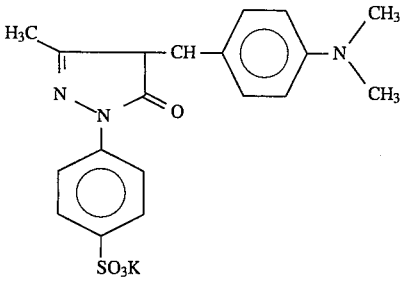

Compound (4)

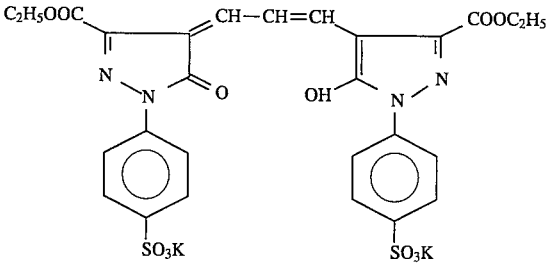

-continued

Compound (5)

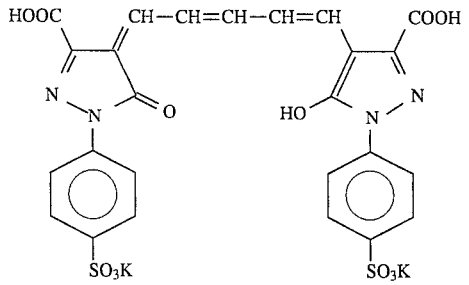

Evaluation of the samples

The samples thus obtained were exposed with a tungsten light source via a step wedge and subjected to a sensitometry at a developing temperature of 38° C., a developing time of 14 seconds and a total processing time of 43 seconds, with an automatic developing machine FG-710NH manufactured by Fuji Photo Film Co., Ltd., wherein LD 8352 and LF 308 manufactured by Fuji Photo Film Co., Ltd. were used for the developing solution and the fixing solution, respectively.

The sensitivity was given by the reciprocal of the exposure providing a density of 3.0 and was expressed by the relative sensitivity, which is shown in Table 1. A gradation was expressed by the gradient of the linear line obtained by connecting the point of the density 0.1 with the point of the density 3.0 in the characteristic curve, which is similarly shown in Table 1.

TABLE 1

| Sample No. | Dye | Compound in Solution 5 Kind | Amount* | Chemical sensitizer | S** | Gradation | Fog |
|---|---|---|---|---|---|---|---|
| 1 (Comp.) | II-5 | — | — | Sulfur/gold | 100 | 5.3 | 0.04 |
| 2 (Comp.) | II-5 | — | — | Selenium/sulfur/gold | 112 | 5.4 | 0.05 |
| 3 (Comp.) | II-5 | $K_4[Fe(CN)_6]$ | $1 \times 10^{-5}$ | Sulfur/gold | 112 | 5.1 | 0.04 |
| 4 (Inv.) | II-5 | $K_4[Fe(CN)_6]$ | $1 \times 10^{-5}$ | Selenium/sulfur/gold | 141 | 6.2 | 0.04 |
| 5 (Comp.) | II-5 | $K_4[Fe(CN)_6]$ | $3 \times 10^{-5}$ | Sulfur/gold | 117 | 5.0 | 0.04 |
| 6 (Inv.) | II-5 | $K_4[Fe(CN)_6]$ | $3 \times 10^{-5}$ | Selenium/sulfur/gold | 151 | 6.1 | 0.04 |
| 7 (Comp.) | II-5 | $K_4[FeCl_2(CN)_4]$ | $1 \times 10^{-5}$ | Sulfur/gold | 107 | 5.0 | 0.04 |
| 8 (Inv.) | II-5 | $K_4[FeCl_2(CN)_4]$ | $1 \times 10^{-5}$ | Selenium/sulfur/gold | 132 | 6.0 | 0.04 |
| 9 (Comp.) | II-5 | $K_2[Ru(CN)_6]$ | $1 \times 10^{-5}$ | Sulfur/gold | 110 | 5.2 | 0.04 |
| 10 (Inv.) | II-5 | $K_2[Ru(CN)_6]$ | $1 \times 10^{-5}$ | Selenium/sulfur/gold | 135 | 6.1 | 0.04 |
| 11 (Comp.) | II-5 | $K_2[OsCl(CN)_5]$ | $1 \times 10^{-5}$ | Sulfur/gold | 107 | 5.0 | 0.04 |
| 12 (Inv.) | II-5 | $K_2[OsCl(CN)_5]$ | $1 \times 10^{-5}$ | Selenium/sulfur/gold | 129 | 6.0 | 0.04 |
| 13 (Comp.) | II-5 | $K_2[Re(CN)_5(SCN)]$ | $1 \times 10^{-5}$ | Sulfur/gold | 107 | 5.0 | 0.04 |
| 14 (Inv.) | II-5 | $K_2[Re(CN)_5(SCN)]$ | $1 \times 10^{-5}$ | Selenium/sulfur/gold | 129 | 6.0 | 0.04 |
| 15 (Comp.) | II-5 | $K_3[IrCl_2(CN)_4]$ | $1 \times 10^{-5}$ | Sulfur/gold | 110 | 5.1 | 0.04 |
| 16 (Inv.) | II-5 | $K_3[IrCl_2(CN)_4]$ | $1 \times 10^{-5}$ | Selenium/sulfur/gold | 132 | 6.0 | 0.04 |
| 17 (Comp.) | II-14 | $K_4[Fe(CN)_6]$ | $1 \times 10^{-5}$ | Sulfur/gold | 110 | 5.2 | 0.04 |
| 18 (Inv.) | II-14 | $K_4[Fe(CN)_6]$ | $1 \times 10^{-5}$ | Selenium/sulfur/gold | 135 | 6.0 | 0.04 |
| 19 (Comp.) | II-16 | $K_4[Fe(CN)_6]$ | $1 \times 10^{-5}$ | Sulfur/gold | 110 | 5.1 | 0.04 |
| 20 (Inv.) | II-16 | $K_4[Fe(CN)_6]$ | $1 \times 10^{-5}$ | Selenium/sulfur/gold | 132 | 6.1 | 0.04 |

*mole/mole Ag
**Relative sensitivity

As is apparent from the results in Table 1, a high sensitivity and a hard gradation can be achieved by sensitizing the silver halide grains containing the iron, ruthenium, osmium, rhenium, and iridium compounds represented by Formula I having a cyanide ligand, with a selenium sensitizer and by spectrally sensitizing the silver halide grains with the sensitizing dye represented by Formula II.

EXAMPLE 2

The film of Sample No. 1 prepared in Example 1 was subjected to a 50% blackening exposure and then to a processing of 600 $m^2$ with the automatic developing machine FG-360A in the developing solution A and fixing solution A each having the following composition with the replenishing amounts of the developing solution and fixing solution each set at 180 $ml/m^2$.

The developing solution A and fixing solution A, which were exhausted in the above preliminary step, are denoted as a developing solution B and fixing solution B.

Thereafter, Samples No. 1 to 4 and 9 to 12, each prepared by Example 1, were processed in the same manner as in Example 1 in the developing solution A and fixing solution A and the developing solution B and fixing solution B. They were then evaluated photographic performance.

| Developing solution A: | |
|---|---|
| Diethylenetriaminepentacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-hexahydro-2-thioxo-4-(1H)-quinazoline | 0.09 g |

-continued

| | |
|---|---|
| Sodium 2-mercaptobenzimidazole-5-sulfonate | 0.3 g |
| Water to make | 1 liter |
| Potassium hydroxide was added to adjust pH to | 10.7 |
| Fixing solution A: | |
| Sodium thiosulfate pentahydrate | 300 g |
| Sodium sulfite | 7 g |
| Sodium metabisulfite | 20 g |

-continued

| | |
|---|---|
| EDTA | 0.025 g |
| Water to make | 1 liter |
| pH was adjusted to | 5.7 |

TABLE 2

| | Compound in Solution 5 | | | DA + FA*4 | | DB + FB*5 | |
|---|---|---|---|---|---|---|---|
| Sample No. | Kind | Amount*1 | Chemical sensitizer | S*2 | G*3 | S*2 | G*3 |
| 1 (Comp.) | — | — | Sulfur/gold | 100 | 5.3 | 83 | 4.6 |
| 2 (Comp.) | — | — | Selenium/sulfur/gold | 112 | 5.4 | 98 | 4.9 |
| 3 (Comp.) | $K_4[Fe(CN)_6]$ | $1 \times 10^{-5}$ | Sulfur/gold | 112 | 5.1 | 95 | 4.4 |
| 4 (Inv.) | $K_4[Fe(CN)_6]$ | $1 \times 10^{-5}$ | Selenium/sulfur/gold | 141 | 6.2 | 138 | 6.1 |
| 9 (Comp.) | $K_2[Ru(CN)_6]$ | $1 \times 10^{-5}$ | Sulfur/gold | 110 | 5.2 | 93 | 4.4 |
| 10 (Inv.) | $K_2[Ru(CN)_6]$ | $1 \times 10^{-5}$ | Selenium/sulfur/gold | 135 | 6.1 | 129 | 6.0 |
| 11 (Comp.) | $K_2[OsCl(CN)_5]$ | $1 \times 10^{-5}$ | Sulfur/gold | 107 | 5.0 | 91 | 4.2 |
| 12 (Inv.) | $K_2]OsCl(CN)_5]$ | $1 \times 10^{-5}$ | Selenium/sulfur/gold | 129 | 6.0 | 123 | 5.8 |

*1mole/mole Ag
*2Relative sensitivity
*3Gradation
*4Developing solution A + fixing solution A
*5Developing solution B + fixing solution B As is apparent from the results in Table 2, rapid processing with a high sensitivity and a hard gradation can be achieved even if there is 200 ml/m$^2$ or less in the replenishing solutions for the developing solution and fixing solution, by sensitizing the silver halide grains containing the metal compounds represented by Formula I having a cyanide ligand with a selenium sensitizer and by spectrally sensitizing the silver halide grains with a sensitizing dye represented by Formula II.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one light-sensitive silver halide emulsion layer containing silver halide grains, wherein the silver halide grains contain 50 mol % or more of silver chloride, contain a metal compound represented by Formula I, and have been subjected to chemical sensitization with a sulfur sensitizer, a gold sensitizer and a selenium sensitizer and to spectral sensitization with a sensitizing dye represented by Formula II:

$$[M(CN)_mX_{6-m}]^n \quad \text{(I)}$$

wherein M represents iron, rhenium, osmium, ruthenium, or iridium; X represents a bridging ligand; m is 4, 5 or 6; and n is −2, −3 or −4;

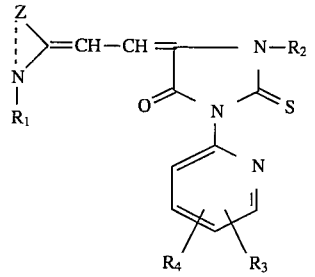

(II)

wherein Z represents a group of atoms necessary to form an oxazole nucleus, a benzoxazole nucleus or a naphthooxazole nucleus; $R_1$ represents an alkyl group which may optionally have a substituent; $R_2$ represents an alkoxycarbonylalkyl group, a hydroxyalkyl group, a hydroxyalkoxyalkyl group, a carbamoylalkyl group, a hydroxyphenyl group, or a hydroxyalkylphenyl group; and $R_3$ and $R_4$ may be the same or different and each represents a hydrogen atom, an alkyl group, an alkoxy group, an alkylsulfonyl group, a sulfo group, a chlorine atom, a fluorine atom, or a carboxy group.

2. The silver halide photographic material described in claim 1, wherein the selenium sensitizer is a compound represented by Formula III:

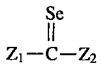

(III)

wherein $Z_1$ and $Z_2$ may be the same or different and each represents an alkyl group, an alkenyl group, an aralkyl group, an aryl group, a heterocyclic group, —$NR_1(R_2)$, —$OR_3$, or —$SR_4$; $R_1$, $R_2$, $R_3$, and $R_4$ may be the same or different and each represents an alkyl group, an aralkyl group, an aryl group, or a heterocyclic group.

3. The silver halide photographic material described in claim 1, wherein the selenium sensitizer is a compound represented by Formula IV:

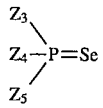

(IV)

wherein $Z_3$, $Z_4$ and $Z_5$ may be the same or different and each represents an aliphatic group, an aromatic group, a heterocyclic group, —$OR_7$, —$NR_8(R_9)$, —$SR_{10}$, —$SeR_{11}$, X, or a hydrogen atom; wherein $R_7$, $R_{10}$ and $R_{11}$ each represents an aliphatic group, an aromatic group, a heterocyclic group, a hydrogen atom, or a cation; and $R_8$ and $R_9$ each represents an aliphatic group, an aromatic group, a heterocyclic group, or a hydrogen atom; and X represents a halogen atom.

4. The silver halide photographic material described in claim 1, wherein M is iron.

5. The silver halide photographic material described in claim 1, wherein the metal compound having a cyanide ligand represented by Formula I was added to the grains during the formation thereof.

6. The silver halide photographic material described in claim 1, wherein Z forms a benzoxazole nucleus.

7. A method for processing a silver halide photographic material comprising the steps of image-wise exposing the photographic material and developing the image-wise exposed photographic material, wherein the photographic material comprises a support having thereon at least one light-sensitive silver halide emulsion layer containing silver halide grains, said silver halide grains (i) containing 50 mol % or more of silver chloride, (ii) containing a metal compound represented by Formula I and (iii) having been subjected to chemical sensitization with a sulfur sensitizer, a gold sensitizer and a selenium sensitizer and to spectral sensitization with a sensitizing dye represented by Formula II:

$$[M(CN)_mX_{6-m}]^n \quad (I)$$

wherein M represents iron, rhenium, osmium, ruthenium, or iridium; X represents a bridging ligand; m is 0, 1 or 2; and n is −2, −3 or −4;

(II)

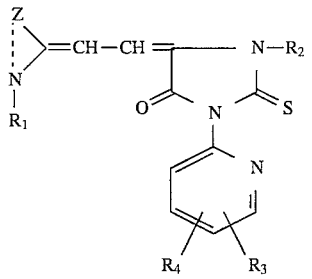

wherein Z represents a group of atoms necessary to form an oxazole nucleus, a benzoxazole nucleus or a naphthooxazole nucleus; $R_1$ represents an alkyl group which may optionally have a substituent; $R_2$ represents an alkoxycarbonylalkyl group, a hydroxyalkyl group, a hydroxyalkoxyalkyl group, a carbamoylalkyl group, a hydroxyphenyl group, or a hydroxyalkylphenyl group; and $R_3$ and $R_4$ may be the same or different and each represents a hydrogen atom, an alkyl group, an alkoxy group, an alkylsulfonyl group, a sulfo group, a chlorine atom, a fluorine atom, or a carboxy group.

8. The method described in claim 7, wherein the light-sensitive material is developed with an automatic developing machine in a total processing time of 15 to 60 seconds.

9. The method described in claim 7, wherein the light-sensitive material is developed with an automatic developing machine having a line speed of 1000 mm/minute or more.

10. The method described in claim 7, wherein the light-sensitive material is developed with an automatic developing machine in which the replenishing amounts for a developing solution and a fixing solution each are 200 ml/cm$^2$ or less.

* * * * *